US008863993B2

(12) United States Patent
Donnette et al.

(10) Patent No.: US 8,863,993 B2
(45) Date of Patent: Oct. 21, 2014

(54) PRODUCT DISPENSING DEVICE COMPRISING A PUMP AND A DISPENSING END PIECE

(71) Applicants: Xavier Donnette, Soleymieu (FR); Jose Camba, Amberieu en Bugey (FR); Philippe Sahm, Aix les Bains (FR)

(72) Inventors: Xavier Donnette, Soleymieu (FR); Jose Camba, Amberieu en Bugey (FR); Philippe Sahm, Aix les Bains (FR)

(73) Assignee: Rexam Healthcare la Verpilliere S.A.S. (FR)

( * ) Notice: Subject to any disclaimer, the term of this patent is extended or adjusted under 35 U.S.C. 154(b) by 0 days.

(21) Appl. No.: 13/709,844

(22) Filed: Dec. 10, 2012

(65) Prior Publication Data

US 2013/0175303 A1 Jul. 11, 2013

Related U.S. Application Data

(63) Continuation of application No. PCT/FR2011/051318, filed on Jun. 9, 2011.

(30) Foreign Application Priority Data

Jun. 10, 2010 (FR) ..... 10 54608

(51) Int. Cl.
*B65D 88/54* (2006.01)
*B05B 11/00* (2006.01)

(52) U.S. Cl.
CPC ..... *B05B 11/0008* (2013.01); *B05B 11/0075* (2013.01); *B05B 11/3049* (2013.01); *B05B 11/3042* (2013.01); *B05B 11/3069* (2013.01); *B05B 11/0032* (2013.01); *B05B 11/3004* (2013.01); *B05B 11/0064* (2013.01); *B05B 11/3052* (2013.01)
USPC ..... 222/321.6; 215/274

(58) Field of Classification Search
CPC ..... B05B 11/0008; B05B 11/3049; B05B 11/3047; B05B 11/3004; B05B 11/0064; B05B 11/3052
USPC ..... 222/321.6–321.9, 321.1, 321.2, 402.1, 222/402.24, 340; 215/274–276, 352
See application file for complete search history.

(56) References Cited

U.S. PATENT DOCUMENTS 4,773,553 A * 9/1988 Van Brocklin ..... 215/272
5,762,238 A * 6/1998 Liang ..... 222/321.9

(Continued)

FOREIGN PATENT DOCUMENTS

EP 0653359 A1 5/1995
FR 2859983 A1 3/2005
FR 2887232 A1 12/2006

OTHER PUBLICATIONS

International Search Report Application No. PCT/FR2011/051318 Completed: Aug. 23, 2011; Mailing Date: Aug. 31, 2011 2 pages.

*Primary Examiner* — Lien Ngo
(74) *Attorney, Agent, or Firm* — St. Onge Steward Johnston & Reens LLC

(57) ABSTRACT

The fluid dispenser device is fitted on the neck of a reservoir, and it includes a pump having a metering chamber that is closed by a first needle forming a check valve; a dispenser endpiece fitted on the pump including a second needle, forming a check valve, and a thrust surface to enable the device to be activated by a user pressing thereon; a protective cap for the device; a clamping collar carrying the cap; and a fastener member for fastening the device on the neck of the reservoir, the fastener member including an attachment member for attaching the fastener member around the neck and activatable by sliding the collar relative to the fastener member from a pre-assembly configuration to an assembled configuration, an inner ring for centering the pump on the reservoir and an outer ring retaining member for retaining the dispenser endpiece.

9 Claims, 2 Drawing Sheets

(56) References Cited

U.S. PATENT DOCUMENTS

| | | | | |
|---|---|---|---|---|
| 6,186,369 | B1 * | 2/2001 | Rosenthal | 222/321.7 |
| 6,189,739 | B1 | 2/2001 | von Schuckmann | |
| 6,619,495 | B1 * | 9/2003 | Pares Montaner et al. | 215/272 |
| 7,757,902 | B2 * | 7/2010 | Bevans et al. | 222/321.9 |
| 8,550,311 | B2 * | 10/2013 | Cornet et al. | 222/321.9 |
| 2005/0061834 | A1 * | 3/2005 | Garcia et al. | 222/321.7 |
| 2006/0283830 | A1 * | 12/2006 | Jourdin et al. | 215/273 |
| 2009/0045228 | A1 * | 2/2009 | Jourdin et al. | 222/321.9 |

* cited by examiner

PRODUCT DISPENSING DEVICE COMPRISING A PUMP AND A DISPENSING END PIECE

FIELD OF THE INVENTION

The present invention relates to a fluid dispenser device fitted on the neck of a reservoir. For example a device for dispensing medication in the form of a spray and comprising a pump, such as a nasal spray device.

BACKGROUND OF THE INVENTION

Attempts are increasingly being made to limit or eliminate the use of chemical preservatives in fluids, particularly in the medical field. Consequently, it is important for a dispenser device to provide the greatest possible degree of sealing (against liquids, gases, bacteria) between the outside and the inside of the device or the reservoir, i.e. all along the path traveled by the fluid so as to prevent bacteria from developing and contaminating the fluid.

Such devices are often referred to as "preservative-free" devices. They may be provided with a dispenser endpiece that is fitted on the pump and that includes a check valve arranged immediately in front of the fluid dispenser orifice to prevent bacteria developing in the dispenser endpiece. By way of example, one such endpiece is described in publication FR 2 887 232.

SUMMARY OF THE INVENTION

A particular object of the present invention is to provide a dispenser device in which the risk of bacteria developing is even further reduced.

To this end, the invention relates to a fluid dispenser device for fitting on the neck of a reservoir, wherein the device comprises:

- a pump having a metering chamber;
- a dispenser endpiece fitted on the pump and having a thrust surface to enable the device to be activated by a user pressing thereon;
- a protective cap for the device;
- a clamping collar carrying the cap; and
- a fastener member for fastening the device on the neck of the reservoir, the fastener member including attachment means for attaching the member around the neck and activatable by sliding the collar relative to the fastener member from a pre-assembly configuration to an assembled configuration, an inner ring for centering the pump on the reservoir and an outer ring carrying means for retaining the dispenser endpiece.

Thus, it is proposed to make use of a fastener member that guarantees both that the device cannot easily be dismantled from the reservoir, and also that the dispenser endpiece cannot easily be dismantled from the pump, thereby greatly reducing any risk of loss of sterility, e.g. as a result of outside air or bacteria penetrating into the reservoir or the device, whether accidentally or voluntarily. The device is fastened on the reservoir by the attachment means that perform a kind of snap-fastening under activation by the clamping collar, thereby constituting a fastening technique that is practically impossible for the user to dismantle, unlike a screw-fastening. This type of fastening can be thought of as a snap-on fastening. In addition to the snap-fastening function, the fastener member also serves to retain the dispenser endpiece on the device, by means of its outer ring, thereby guaranteeing that the endpiece cannot be removed from the pump on which it is fitted, even when considerable force is applied. It should be observed that the dispenser endpiece is thus retained on the device in two distinct ways: firstly it is fastened on the pump by being fitted on a movable portion of the pump, e.g. as a tight fit, and secondly it is retained by the outer ring of the endpiece, thereby preventing the endpiece fastened on the pump from being pulled off.

It should also be observed that the above-proposed device may be assembled on the reservoir in a single step, which is very advantageous. The dispenser device constitutes a module carrying all of the dispenser elements for fitting on the reservoir, and in particular the pump, the dispenser endpiece, and the protective cap. These elements thus constitute a module that is pre-assembled by means of the fastener member. In order to assemble the reservoir and the protection device, all that needs to be done is to place the device in a pre-assembly position on the neck of the reservoir and to slide the clamping collar, merely by pushing down on the protection cap so as to activate the attachment means. Since the cap is carried by the clamping collar, pressure applied to the cap can be transmitted directly to the collar. Mounting in a single step in this way is advantageous since the inside of the dispenser device is protected by the cap and is therefore not in contact with the outside, thereby avoiding any risk of contamination during final assembly. This embodiment enables the metering device to be manufactured in a location other than that in which it is assembled on the bottle, and without running any particular risk of pollution.

It should be observed that the metering chamber of the pump is preferably closed in its top portion by a first needle forming a check valve. Furthermore, the dispenser endpiece optionally includes a second needle, forming a check valve.

The dispenser device may also include one or more of the following characteristics, taken singly or in combination.

The clamping collar includes releasable snap-fastener means for engaging the cap, preferably in the form of an annular groove. Thus, since the cap is attached to the collar, which is itself attached to the fastener member that carries the pump and the dispenser endpiece, manipulating only the cap serves to manipulate the entire device.

The inner ring for centering the pump has a reinforcement zone for reinforcing a resilient tab that needs to be forced past in order to dispense fluid. Such a resilient tab may be used for constituting an activation hard point that guarantees that the user exerts sufficient pressure on the device to ensure a full dose of fluid is dispensed, which is particularly important with medication.

The dispenser endpiece has a covering carrying firstly the thrust surface and secondly a ring for retaining the endpiece, the ring being mounted to slide relative to the outer ring of the fastener member, preferably inside said outer ring, and cooperating by coming into abutment against the retaining means carried by the fastener member. The thrust surface is generally designed to come into contact with two of the user's fingers. By way of example, it may be in the form of two fins projecting radially, i.e. perpendicularly to the axis of the retaining ring. The covering preferably also includes a housing for receiving a needle forming a check valve and closing the fluid dispenser orifice by means of a resilient return force exerted by a spring.

The dispenser endpiece includes, in addition to the endpiece retaining ring, a base that is fastened on a movable portion of the pump. The base and the retaining ring are two distinct portions of the endpiece, the base preferably being fitted inside the covering and presenting a tubular portion that is engaged on the movable portion of the pump in leaktight manner. The tubular portion of the base is located at least in part inside the retaining ring, being coaxial therewith.

The retaining means comprise a retaining lug constituting an abutment for an annular rib formed on the retaining ring. Naturally, it can be understood that the retaining means may have a plurality of lugs. An advantage of a continuous annular rib lies in the fact that there is no need to provide for any particular angular arrangement for the endpiece while it is being mounted on the device.

The outer ring of the fastener member carries on its outside surface a top abutment for holding the clamping collar in its pre-assembly configuration of the device. This abutment serves to hold the collar stationary on the member, before being assembled on the reservoir.

The attachment means for attaching the member around the neck comprise a bottom abutment for holding the clamping collar in its pre-assembly configuration of the device. This abutment serves to hold the collar stationary relative to the member before it is assembled on the reservoir, and it may serve as a bearing surface for the clamping collar in order to deform deformable means while it is sliding. The bottom abutment is preferably carried by deformable means, e.g. resilient means.

The fastener member is made of plastics material, which is particularly appropriate in the medical field since that avoids generating harmful particles.

The clamping collar is configured in such a manner that thrust applied to the cap is transmitted directly to the clamping collar so as to cause it to pass from its pre-assembly configuration to its assembled configuration. For this purpose, the clamping collar carries a bearing surface against which the cap bears, preferably in the form of a flange projecting outwardly from a main wall of the collar.

The invention also provides an assembly comprising a reservoir and a device according to any preceding claim, wherein the clamping collar can take up a pre-assembly position and an assembled position on the neck of the reservoir, and the attachment means for attaching the member around the neck comprise deformable means that are not deformed in the pre-assembly position and that are deformed in the assembled position, where they are held deformed by the clamping collar. Nevertheless, it should be observed that in another embodiment, the deformable means may be deformed in the pre-assembly position and non-deformed in the assembled position, being held in the non-deformed configuration by the clamping collar. The deformable means are preferably resilient.

The invention also provides a method of assembling such a dispenser device on a reservoir, in which method the device is fitted on the neck of the reservoir in a first position referred to as a "pre-assembly" position, and subsequently pressure is applied on the protective cap, thereby causing the clamping collar to slide so that the dispenser device takes up a second position referred to as an "assembled" position.

BRIEF DESCRIPTION OF THE DRAWINGS

The invention can be better understood on reading the following description given purely by way of example and made with reference to the drawings, in which.

DETAILED DESCRIPTION OF THE INVENTION

Figure 1:
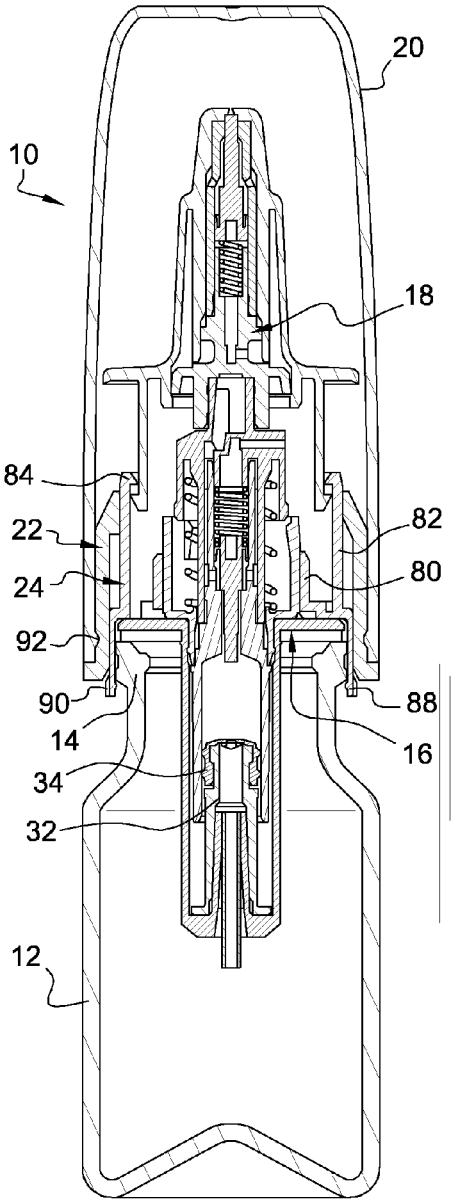
FIG. 1 is a diagrammatic section view of a dispenser device in its pre-assembly position on a reservoir.
Figure 2:
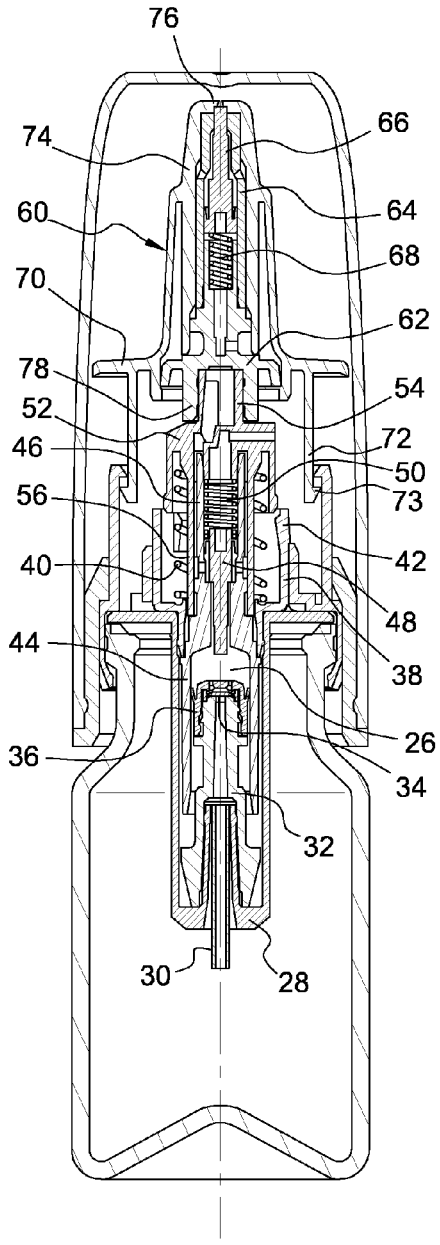
FIG. 2 is a diagrammatic section view of a dispenser device in a variant embodiment, in its assembled position on the reservoir.

A dispenser device 10 is fitted on a reservoir 12 in order to dispense a fluid. In this example, the fluid is liquid and it is a pharmaceutical liquid for use as a nasal spray. The reservoir 12 has a neck 14 on which the device 10 may take a pre-assembly position, as shown in FIG. 1, and an assembled position, as shown in FIG. 2.

The device 10 comprises a pump 16, a dispenser endpiece 18, a protective cap 20, a clamping collar 22, and a fastener member 24.

The pump 16 has a "stationary" portion and a "movable" portion that slide relative to each other, so as to eject the fluid stored in a metering chamber 26 that defines a metering volume, the fluid being dispensed when the device is activated. The stationary portion of the pump 16 comprises a pump body 28 receiving a dip tube 30 for taking the fluid and carrying a piston slidable in the chamber 26. The pump body is fitted on the top surface of the neck 14 of the reservoir, a gasket being interposed between the body 28 and the neck 14. The piston has a support 32 and a diaphragm 34 constituting a check valve. In FIG. 1, the diaphragm is made integrally with a cylindrical elastomer skirt carrying sealing means that slide in the chamber 26. In FIG. 2, in addition to the diaphragm, the piston has an element 36 for fastening the diaphragm, which element is a part that is distinct from the diaphragm and includes the cylindrical skirt and the sliding sealing means. The stationary portion of the pump 16 also has a sleeve 38 that is fastened in the pump body 28, e.g. by being a tight fit, and that serves as a seat for a first spring 40. The sleeve 38 has one or more resilient tabs 42 that need to be forced past in order to dispense fluid, thereby constituting a hard point on activation. The movable portion of the pump 16 is also referred to as a dispenser head. It comprises a first cylinder 44 slidably mounted inside the pump body 28, cooperating with the piston to define the metering chamber 26. The dispenser head also includes a second cylinder 46, possibly made integrally with the first cylinder 44. A first needle 48 constituting a check valve is slidably mounted inside the second cylinder 46 to slide between a rest position and an activated position under drive from a second spring 50. The needle 48 has a base that is mounted in leaktight manner in the second cylinder 46, a rod configured to be capable in the rest position of the pump of closing an orifice formed in the bottom end of the second cylinder 46, and an end that projects a little into the metering chamber 26 when the needle 48 is in the activated position. The movable portion of the pump 16 also has a support 52 or "ejection tube" that has a tubular end 54 on which the dispenser endpiece 18 is fastened. The support 52 has an inner skirt 56 and an outer skirt, with the spring 40 being received between the skirts. The movable portion of the pump slides relative to the stationary portion between a rest position and an activated position. The support 52 also has means for passing the liquid from the metering chamber 26 to the dispenser endpiece 18, which means are arranged in particular between the second cylinder 46 and the inner skirt 56 of the support 52.

The dispenser endpiece 18 has a covering 60 within which there are fitted a base 62 and a cylinder 64 housing a second needle 66 forming a check valve that is under drive from a third spring 68. This check valve serves to guarantee that the spray nozzle is sealed against contaminants. The covering 60 has a thrust surface 70 in the form of two fins to enable a user to activate the device by pressing on them. The covering 60 also has a ring 72 for retaining the endpiece by co-operating with the fastener member 24. For this purpose, the ring 72 carries a continuous annular rib 73 at its bottom end. The covering 60 also has a spray end 74 that is provided with a spray orifice 76 that is closed by the pin 66 under drive from the spring 68. The spray end 74 co-operates with the cylinder 64 to define a dispenser swirl chamber. The base 62 is fitted inside the covering 60, e.g. as a tight fit, and it has a tubular portion 78 that is fastened on the portion 54, e.g. by being a tight fit around the portion 54.

Figure 3:
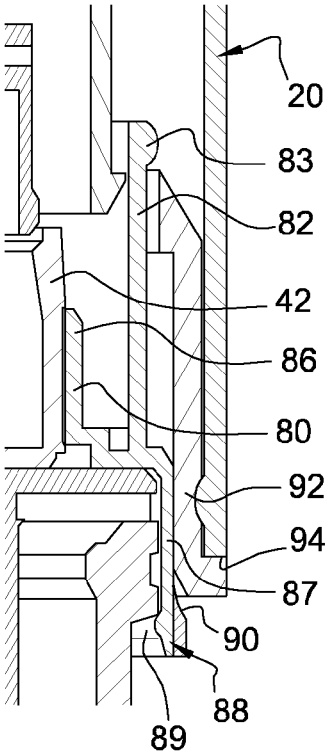
FIG. 3 is an enlarged view of a portion of FIG. 1.
Figure 4:
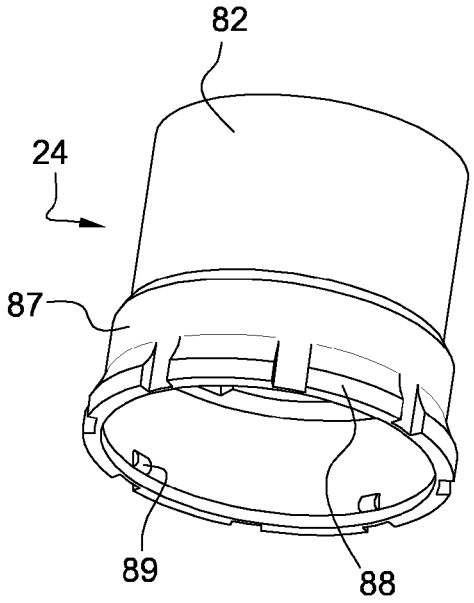
FIG. 4 is a perspective view of a fastener member of the devices of FIGS. 1 and 2.

The fastener member 24 is made of plastics material. On its top portion it includes an inner ring 80 for centering the pump 16 on the reservoir 12 and an outer ring 82. At its top end, the outer ring 82 carries means 84 for retaining the dispenser endpiece 18 and co-operating with the covering 60 by abutting thereagainst. The means 84 include one or more retaining lugs forming an abutment for the rib 73. The outer ring 82 also carries on its outside surface a top abutment 83 for holding the collar 22 in its pre-assembly configuration of the device, as described below. The inner ring 80 serves to position the pump 16 on the fastener member 24. It also has a reinforcement zone 86 for reinforcing the resilient tab 42, shown in FIG. 3, so as to avoid the plastic deformation of the tab. The member 24 also has a bottom skirt 87 carrying means 88 for attaching the member around the neck 14 and activatable by sliding the collar 22 relative to the fastener member from a pre-assembly configuration to an assembled configuration. The attachment means 88 are visible in FIG. 4 and comprise resilient means that constitute a bottom abutment 90 for holding the clamping collar 22 in its pre-assembly configuration, as shown in FIG. 1, and that are deformable in such a manner as to enable the collar to be forced past them, and they are capable of exerting a return force on the collar 22 when it is in the assembled configuration as shown in FIG. 2. This return force presses the means 88 against the collar 22 and thus holds the collar 22 in the assembled configuration. The fastener member 24 also has lugs 89 enabling the member 24 to be held in the pre-assembly position on the neck of the reservoir.

The clamping collar 22 is also made of plastics material. It is cylindrical in shape in order to be capable of sliding around the bottom skirt 87 of the member 24. The collar 22 has means 92 for releasably snap-fastening with the cap 20, e.g. an annular groove 92 co-operating with an annular rib on the cap 20. The collar 22 carries the cap 20 and is configured in such a manner that thrust applied to the cap 20 is transmitted directly to the collar 22 so as to make it pass from its pre-assembly configuration to its assembled configuration. For this purpose, the collar 22 has a bearing surface 94 against which the cap 20 bears, which surface is in the form of an outwardly-directed flange 94 projecting from the collar 22.

There follows a description of how the device 10 is assembled on the reservoir 12.

The device 10 is initially assembled independently of the reservoir 12, e.g. at a first location, with the device being assembled in a pre-assembly configuration. More precisely, the fastener member 24 and the clamping collar 22 are fastened around the pump body 28, and then the stationary portion of the pump 16 is assembled by placing the piston, the tube 30, and the sleeve 38 on the pump body 28, together with the movable portion of the pump with the spring 40, the support 52, and the cylinders 44, 46 carrying the needle 48 and the spring 50 being fitted to the stationary portion. Thereafter, the dispenser endpiece 18 is fitted on the pump 16 and in the member 24, firstly by inserting the rib 73 inside the ring 82, forcing it past the lugs 84, and secondly by fastening the base 62 around the portion 54. Thereafter, the cap 20 is fitted on the clamping collar 22. This produces a device in its pre-assembly configuration, which device may optionally be transported to a second location for the purpose of being mounted on the reservoir 12 in the pre-assembly position, as shown in FIG. 1.

Thereafter, the transition from the pre-assembly position to the assembled position as shown in FIG. 2 is particularly simple. It suffices to press down on the cap 20, thereby causing the collar 22 to slide and deform the means 88 as it slides, causing them to fold inwards, such that they form jaws around the neck of the reservoir 12. The collar 22 slides until its top end comes into abutment against a horizontal surface of the member 24, as can be seen in FIG. 2. This defines an assembled position of the device 10 on the reservoir 12, corresponding to an assembled configuration in which the collar 22 is permanently fastened relative to the member 24, as a result of the high levels of friction that are generated by the return force of the attachment means 88 against the collar 22.

It can be understood that the device 10 is particularly advantageous if it is used with a fluid that has no preservative agent. The retention of the endpiece 18 by the means 84 provides an additional guarantee that the endpiece will not become detached from the device as a result of the device being dropped or as a result of manipulation by the user. Furthermore, the user cannot dismantle the attachment means 88.

The device 10 is particularly suitable for an "airless" type system, i.e. a system that has no intake of air. This type of pump is used when it is important to ensure that no bacteria comes into contact with the fluid, and the device 10 is a device that is effective for preventing bacteria penetrating therein.

The structure of the device 10 and the way it operates are not limited to the above description.

It should be observed that the above-described dispenser device 10 could have the same functions while being fastened in some other way on the neck of the reservoir. The fastener member need not be fastened using a snap-fastening technique, but it could be fastened by crimping or by screw-fastening. Under such circumstances, the parts used would be similar except that the device would not have a clamping collar, the cap being fitted directly on the outer ring of the fastener member, and the fastener member, instead of having means for resiliently attaching to the neck, would have means for fastening by crimping or by screw-fastening.

The invention claimed is:

1. A fluid dispenser device for fitting on the neck of a reservoir, wherein the device comprises:

a pump having a metering chamber;

a dispenser endpiece fitted on the pump and having a thrust surface to enable the device to be activated by a user pressing thereon;

a protective cap for the device;

a clamping collar carrying the cap;

a fastener member, distinct from said pump, for fastening the device on the neck of the reservoir, the fastener member including an attachment member for attaching the fastener member around the neck and activatable by sliding the collar relative to the fastener member from a pre-assembly configuration to an assembled configuration, an inner ring for centering the pump on the reservoir and an outer ring retaining member for retaining the dispenser endpiece; wherein the inner ring for centering the pump abuts and reinforces a sleeve having at least one resilient tab that a movable portion of said pump needs to be forced past in order to dispense fluid; and wherein the attachment member for attaching the fastening member around the neck comprises a bottom abutment for holding the clamping collar in its pre-assembly configuration of the device.

2. The device according to claim 1, wherein the dispenser endpiece has a covering carrying firstly the thrust surface and secondly a ring for retaining the endpiece, the ring being mounted to slide relative to the outer ring of the fastener member, and co-operating by coming into abutment against the retaining member carried by the fastener member.

3. The device according to claim 2, wherein the dispenser endpiece includes, in addition to the endpiece retaining ring, a base that is fastened on a movable portion of the pump.

4. The device according to claim 3, wherein the retaining member comprise a retaining lug constituting an abutment for an annular rib formed on the retaining ring.

5. The device according to claim 1, wherein the outer ring of the fastener member carries on its outside surface a top abutment for holding the clamping collar in its pre-assembly configuration of the device.

6. The device according to claim 1, wherein the clamping collar is configured in such a manner that thrust applied to the cap is transmitted directly to the clamping collar so as to cause it to pass from its pre-assembly configuration to its assembled configuration.

7. An assembly comprising a reservoir and a device according to claim 1, wherein the clamping collar can take up a pre-assembly position and an assembled position on the neck of the reservoir, and the attachment member for attaching the member around the neck comprise a deformable member that is not deformed in the pre-assembly position and that is deformed in the assembled position, where the deformable member is held deformed by the clamping collar.

8. The device according to claim 2, wherein the ring is mounted inside said outer ring.

9. The device according to claim 2, wherein the retaining member comprises a retaining lug constituting an abutment for an annular rib formed on the retaining ring.

* * * * *